United States Patent [19]

Van Heumen et al.

[11] Patent Number: 4,894,936

[45] Date of Patent: Jan. 23, 1990

[54] SYSTEM FOR THE SIMULATION OF HUMAN MOVEMENTS IN A PUPPET SHOW, PROCEDURE FOR PROGRAMMING SUCH A SYSTEM AND A PUPPET SHOW SO OBTAINED

[75] Inventors: Marinus J. L. Van Heumen; Hendricus Smulders, both of Kaatsheuvel; Antoni N. J. Merkx, Drunen, all of Netherlands

[73] Assignee: De Efteling B.V., Kaatsheuvel, Netherlands

[21] Appl. No.: 236,301

[22] Filed: Aug. 23, 1988

Related U.S. Application Data

[63] Continuation of Ser. No. 946,418, Dec. 23, 1986, abandoned.

[30] Foreign Application Priority Data

Dec. 24, 1985 [NL] Netherlands ..... 8503561

[51] Int. Cl.[4] ..... G09F 19/08

[52] U.S. Cl. ..... 40/414; 40/419; 446/358; 446/362

[58] Field of Search ..... 446/358, 359, 361, 362, 446/365, 354; 40/411, 414, 417, 418, 419, 420, 415; 74/89.21, 501 F

[56] References Cited

U.S. PATENT DOCUMENTS

| | | | |
|---|---|---|---|
| 880,988 | 3/1908 | Hall | 74/89.21 |
| 1,225,100 | 5/1917 | Aubrey | 74/501 F |
| 2,213,512 | 9/1940 | Bailer | 40/414 X |
| 3,390,481 | 7/1968 | Runanin | 446/361 X |
| 4,141,176 | 2/1979 | Flicker et al. | 446/359 X |

FOREIGN PATENT DOCUMENTS

| | | | |
|---|---|---|---|
| 494171 | 7/1953 | Canada | 446/358 |
| 657992 | 10/1951 | United Kingdom | 446/362 |
| 666207 | 2/1952 | United Kingdom | 446/362 |

*Primary Examiner*—Mickey Yu

*Attorney, Agent, or Firm*—Pennie & Edmonds

[57] ABSTRACT

System for the simulation of human movements of a puppet as used in a programmable puppet show, which puppet is provided with mutually hingeable parts of the body, in which a number of cam disks to be driven synchronously by a motor (3) are present, each of which can be followed by a roll (4) attached to one end of a lever (6), while the other end of the lever (6) is connected to a Bowden cable (11) capable of transmitting the movement of the lever (6) to a mechanical construction which can make a part of the body perform a desired movement.

4 Claims, 2 Drawing Sheets

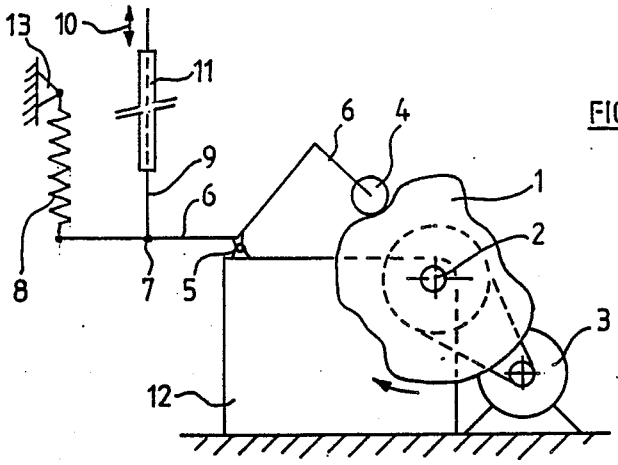
FIG. 1
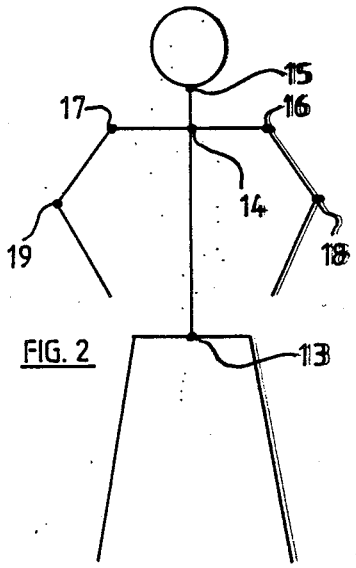
FIG. 2
FIG. 3b
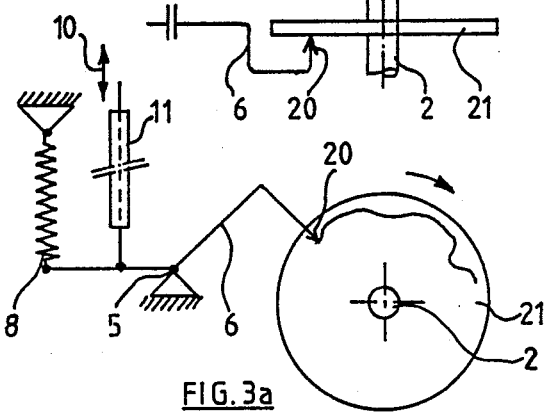
FIG. 3a

SYSTEM FOR THE SIMULATION OF HUMAN MOVEMENTS IN A PUPPET SHOW, PROCEDURE FOR PROGRAMMING SUCH A SYSTEM AND A PUPPET SHOW SO OBTAINED

This is a continuation of application Ser. No. 946,418, filed Dec. 23, 1986, now abandoned.

The invention relates to a system for the simulation of human movements of a puppet as used in a programmable puppet show, in which the puppet is provided with mutually hingeable parts of the body.

The invention also relates to a procedure for the programming of such a system as well as to a puppet show obtained by application of the system and programmed according to the procedure.

In systems as here considered it was hitherto customary to actuate the parts of the body such as the limbs with the aid of pneumatic, hydraulic or electric means and to control the whole from an electronic memory. These systems are extremely costly, however, necessitating high investments, especially when the puppet show in question comprises several figures. In addition, there are technical drawbacks. The said means lend themselves poorly for the realization of smooth, human-like movements. Depending as they do upon the opening and closing of valves and switches, the movements remain jerky. Furthermore, the bodies to be moved become bulky as it is necessary to incorporate pistons and cylinders and the like at suitable places into the limbs, so that these also have to be accelerated or retarded.

The invention results from an awareness that far better, more natural looking effects can be realized at a fraction of the other requisite capital expenditure.

Accordingly, the invention is characterized in that it features a number of cam disks to be driven synchronously by a motor, each of which can be followed by a roll attached to one end of a lever, whilst the other end of the lever is connected to a Bowden cable capable of transmitting the movement of the lever to a mechanical construction which can cause a part of the body to perform a desired movement.

The cam disks in question are preferably mounted on a shaft supported on a solid frame to which the driving motor has also been fitted and which is disposed under or close to the puppet, whilst it is moreover possible for the shaft to carry cam disks of other parts of a puppet show such as another puppet.

In the operation of the system according to the invention it has been found advantageous to make a Bowden cable collaborate with a chain which has been passed over a sprocket wheel. This applies in particular to the construction of a puppet's shoulder. The attendant special problems are solved in the system according to the invention by including two sprocket wheels whose axles cross in the mechanical construction and by conducting the chain which has been passed over one sprocket wheel through a recess in the second sprocket wheel. Even more and better potentialities are afforded by a system in which the axle of the first sprocket wheel is rotatable vis-à-vis the axle of the second sprocket wheel and where the chain section which has been conducted through the second sprocket wheel and which is connected to one end of a Bowden cable is linked through a pivoting coupling to the chain section which has been passed over the first sprocket wheel.

For the programming of the system it is preferred to employ a procedure which is characterized in that instead of a cam disk a disk covered with a writing material and instead of a roll following the cam disk a stylus is mounted, the disk is driven at the normal following speed and a limb of the puppet construction whose movement must be programmed is manually shifted, which motion is transmitted through the Bowden-cable connection to the stylus which traces a curve on the disk, and it is on this basis that the cam disk can be produced.

The invention will now be elucidated with reference to the accompanying drawings, from which further advantages of the invention will emerge, and wherein:

FIG. 1 is a simplified diagram of the drive mechanism for a part of the body;

FIG. 2 is a simplified diagram of a movable puppet from a puppet show;

Figure 4:
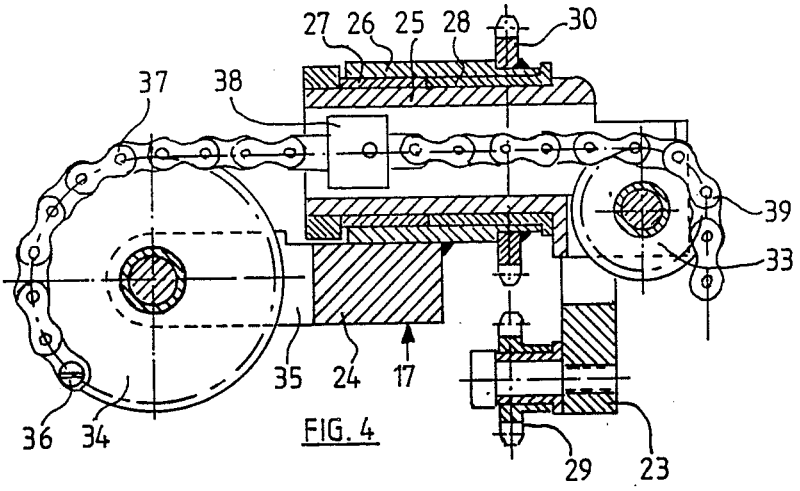
Figure 5:
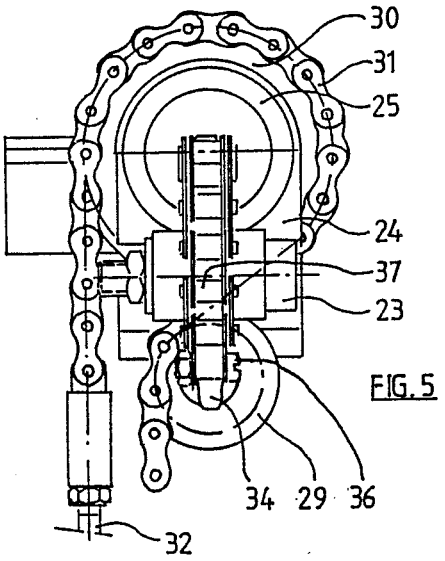
Figure 6:
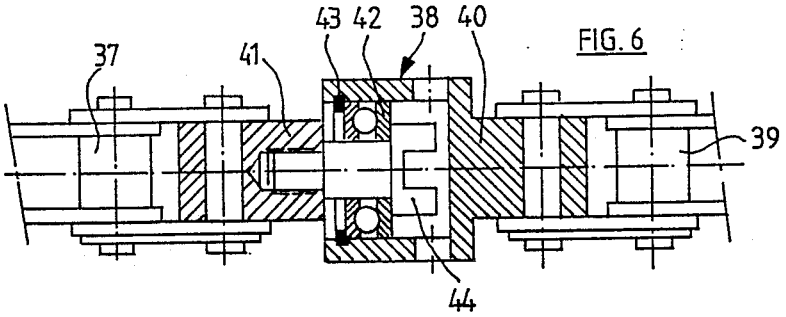

FIGS. 3*a* and 3*b* together schematically show the programming (tracing of a cam disk) in side and in plan view;

FIGS. 4 and 5 are a front and a side view of a coupling member for a shoulder joint; and FIG. 6 depicts a pivoting coupling in a chain.

The cam disk 1 represented in FIG. 1 is one out of a number of disks mounted on a shaft 2 which is driven by a motor 3 provided with a reducing gear. The whole is installed in a frame 12. The outer circumference of each cam disk 1 is followed by a roll 4 attached to the end of a lever 6.

It has been found practical to execute the cam disks in wood (multi-ply wood is eminently suitable) and the rolls 4 are preferably made in nylon. The lever 6 is hingeably fixed to the frame 12 at a point 5. The roll 4 is steadily depressed on the cam disk 1 by means of a tension spring 8. Between the hinge point 5 and the tension spring 8 the lever 6 is fastened to the inner sliding wire 9 of a Bowden cable whose sheathing 11 is immovably secured in place. The wire 9 can be actuated by causing the lever 6 to perform translational motions in the direction 10, which are used to move some part of a puppet's body.

FIG. 2 schematically shows a puppet with the joints 13–19 which are to be moved. Several of these joints are rotatable around two or three axes and for each movement a separate Bowden cable is required and an individual cam disk must be present. The shoulder joints 16 and 17 are of particular interest and the special construction used for them will be described in more detail hereinafter.

The procedure adopted for the programming can be elucidated with reference to FIGS. 3*a* and 3*b*. In fact, this procedure amounts to a reversal of the drive mechanism described hereinbefore. In lieu of the cam disk 1, a round multi-ply wood disk 21 is fitted inside the frame 12. This disk is driven by the motor 3 at the normal speed. Instead of the roll 4, a stylus 20 is mounted. Now if the part of the body to which the appropriate Bowden cable is connected is moved by hand in the desired fashion, the stylus 20 will trace the associated cam contours on the disk 20. The cam disk can then simply be sawed out.

The above-mentioned shoulder construction 17 can be described with reference to FIGS. 4 and 5. The construction comprises a part 23 which is permanently attached to the frame of the puppet and which supports a part 24 connected to the arm of the puppet, part 24 pivoting on part 23. Part 24 is substantially forked and forms a whole with a barrel 26 which accommodates bearing bushes 27 and 28. Part 25 supports the barrel 26 and forms one unit with the part 23. A sprocket wheel 29 is attached to the part 23 and acts in conjunction with a sprocket wheel 30 connected to the rotatable part 24, 26. As is depicted in FIG. 5, a chain 31 can be laid over these wheels 29 and 30, which chain is at one end connected to the wire end of a Bowden cable 32. The part 24, 26 is linked up with the arm of a puppet (not shown), so that upon movement of the cable 32 the arm will move from front to back and vice versa. Furthermore, in the barrel 26 a sprocket wheel 30 is journalled which interacts with a sprocket wheel 34 journalled in the forked part 35 of the rotatable part 24. A part of chain 37 is permanently fixed to the sprocket wheel 34 by means of a bolt 36 and is connected by means of a pivoting coupling 38 to a second chain section 39 which has been passed over the wheel 33 and which links up with a Bowden cable (not shown). A movement of this cable will cause the arm to swing out. The pivoting coupling 38 is required because the axles of the wheels 33 and 34 are mutually rotatable.

The pivoting coupling is represented in FIG. 6. It comprises a coupling element 40 linked to the chain 39 and a coupling element 41 linked to the chain 37. Between the two coupling elements 40 and 41 there is an axial ball bearing 42 of which one ring rests against a ring 43 mounted within the element 40, whilst the second bearing ring rests against a collar of a bolt 44 which has been screwed into the element 41. The coupling so obtained is free from play in axial direction, but renders the two chain sections 37 and 39 freely rotatable inter se.

The invention also encompasses an individual puppet for a programmable puppet show which is provided according to the invention with Bowden cables intended to be operated by mechanisms outside the puppet. Such driving mechanisms may, according to the invention, consist of cam disks or curvilinear disks, motor-driven spindles, hydraulic or pneumatic cylinders.

The invention presents the advantage that several curvilinear disks and, in consequence, the movements of several Bowden cables can be programmed simultaneously.

Instead of making the rolls 4 follow the outer circumference of a cam disk or curvilinear disk, it is also possible to cut a groove into the cam disk 1 through which a wheel is to run. The springs which supply the requisite retractive forces can then be dispensed with, on the understanding that the cables used in such an embodiment are able to withstand both tensile and compressive loads.

The shoulder construction according to the invention makes it possible to turn the arm through a wider angle than can be achieved with other constructions.

We claim:

1. A system for simulating human movements of a puppet having mutually hingeable limb members and which is used in a programmable puppet show comprising: a solid frame member which rotatably supports a drive shaft; a plurality of cam disks adapted to be synchronously driven by a driving motor, said cam disks being operatively associated with said drive shaft; a plurality of rolls, each of which communicates with one of said cam disks; a lever having a first end associated with one of said rolls; a spring associated with a second end of said lever, said spring being externally disposed with respect to said puppet; a Bowden cable having a first and a second end, said first end of said Bowden cable being associated with said lever; and at least one sprocket wheel, positioned inside of the puppet and associated with said limb member, said at least one sprocket wheel having a chain passed thereover, one end of said chain being associated, within the puppet, with said second end of said Bowden cable, whereby when said drive shaft is rotated by said driving motor, said roll causes said lever to bidirectonally move causing said Bowden cable to transmit the bidirectional movement of said lever, via said chain and said first sprocket wheel, to said limb member to permit said limb member to move in a predetermined manner which simulates the human movement, and whereby said spring enables said roll to remain in communication with said cam disks as said cam disk is being rotated by said drive shaft.

2. The system according to claim 1 further comprising a second sprocket wheel positioned inside of the puppet, each of said first and said second sprocket wheel including an axle and being arranged in a manner such that said axles are disposed in a crosswise relationship with respect to each other, thereby permitting said first and said second sprocket wheels to move independently relative to each other and whereby said chain passing over said first sprocket wheel is conducted through a recess defined in said second sprocket wheel.

3. The system according to claim 2 wherein the axle of said first sprocket wheel is rotatable vis-a-vis the axle of said second sprocket wheel and wherein a first segment of said chain passing over said first sprocket wheel is pivotably coupled by coupling means to a second segment of said chain conducted through the recess in said second sprocket wheel, said second segment being associated with said second end of said Bowden cable for allowing an independent two way bidirectional movement of said limb member.

4. A system according to claim 3 wherein said first chain segment is permanently fixed to said first sprocket wheel.

* * * * *